US011773612B1

(12) United States Patent
McNeilly

(10) Patent No.: US 11,773,612 B1
(45) Date of Patent: Oct. 3, 2023

(54) TEMPORARY HOMELESS SHELTER

(71) Applicant: Shawn McNeilly, Maryville, TN (US)

(72) Inventor: Shawn McNeilly, Maryville, TN (US)

( * ) Notice: Subject to any disclaimer, the term of this patent is extended or adjusted under 35 U.S.C. 154(b) by 0 days.

(21) Appl. No.: 17/828,136

(22) Filed: May 31, 2022

(51) Int. Cl.
*E04H 1/02* (2006.01)
*E04B 1/32* (2006.01)
*E04H 1/00* (2006.01)

(52) U.S. Cl.
CPC ..... *E04H 1/02* (2013.01); *E04B 1/3205* (2013.01); *E04H 1/005* (2013.01)

(58) Field of Classification Search
None
See application file for complete search history.

(56) References Cited

U.S. PATENT DOCUMENTS 2,629,348 A * 2/1953 Kifferstein ..... E04H 9/10 D25/36
4,071,210 A * 1/1978 Mutke ..... B64D 11/0601 244/118.6
4,073,101 A * 2/1978 Yoshida ..... E04B 1/3205 D25/4
4,594,817 A * 6/1986 McLaren ..... A47C 29/003 52/36.2
4,745,643 A * 5/1988 Clarke ..... B63B 29/10 5/8
4,974,376 A * 12/1990 Nielsen ..... E04H 1/125 52/36.2
5,031,652 A * 7/1991 Lester ..... E04H 15/36 135/137
5,343,887 A * 9/1994 Danaher ..... E04H 15/40 135/156
6,427,630 B1 * 8/2002 Oehler, Jr. ..... A01K 1/00 119/486
7,880,121 B2 * 2/2011 Naylor ..... E04D 13/103 219/200
8,474,215 B2 7/2013 DeRose
8,695,285 B2 4/2014 Reinmann, Jr
8,813,434 B2 * 8/2014 Koppelman ..... E04H 1/1222 52/79.8
9,376,829 B2 * 6/2016 King, III ..... E02D 5/801
10,041,268 B1 * 8/2018 Bunn ..... E04H 9/14
D863,593 S 10/2019 Tsukii
11,109,519 B2 8/2021 Deighton
11,242,693 B1 * 2/2022 Galindo ..... E04B 1/08
2003/0009954 A1 * 1/2003 Bradley ..... E04H 1/1205 52/745.01

(Continued)

FOREIGN PATENT DOCUMENTS

GB 2465330 5/2010

*Primary Examiner* — Joshua K Ihezie
(74) *Attorney, Agent, or Firm* — Kyle A. Fletcher, Esq.

(57) ABSTRACT

The temporary homeless shelter comprises a reinforced concrete pipe, a rear wall, and a front door. The reinforced concrete pipe may be closed by the rear wall on one end and by the front door on the opposite end. The temporary homeless shelter may be adapted to protect a homeless person from the weather. Air may flow through the reinforced concrete pipe when one or more rear vents and one or more front vents are open. Heated water may be pumped through tubing incorporated into a pipe wall to heat the interior of the reinforced concrete pipe. A storage area located under a bed platform within the reinforced concrete pipe may be operable to store personal belongings.

19 Claims, 5 Drawing Sheets

(56) References Cited

U.S. PATENT DOCUMENTS

| | | | | |
|---|---|---|---|---|
| 2006/0289000 | A1* | 12/2006 | Naylor | F24C 7/043 126/96 |
| 2007/0296605 | A1* | 12/2007 | Manolescu | E04H 9/029 340/6.1 |
| 2008/0016792 | A1* | 1/2008 | Messman | E04B 1/3205 52/93.1 |
| 2010/0025008 | A1* | 2/2010 | Walford | F28F 17/005 165/45 |
| 2010/0122499 | A1 | 5/2010 | Willnauer | |
| 2013/0036702 | A1* | 2/2013 | Pacetti | E04H 1/1205 52/653.1 |
| 2013/0180191 | A1* | 7/2013 | Teron | F24D 3/145 52/220.1 |
| 2020/0232205 | A1* | 7/2020 | Richmond | E04B 1/34823 |

* cited by examiner

TEMPORARY HOMELESS SHELTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of temporary housing, more specifically, a temporary homeless shelter.

SUMMARY OF INVENTION

The temporary homeless shelter comprises a reinforced concrete pipe, a rear wall, and a front door. The reinforced concrete pipe may be closed by the rear wall on one end and by the front door on the opposite end. The temporary homeless shelter may be adapted to protect a homeless person from the weather. Air may flow through the reinforced concrete pipe when one or more rear vents and one or more front vents are open. Heated water may be pumped through tubing incorporated into a pipe wall to heat the interior of the reinforced concrete pipe. A storage area located under a bed platform within the reinforced concrete pipe may be operable to store personal belongings.

An object of the invention is to provide protection from the elements for a homeless person.

Another object of the invention is to provide a reinforced concrete pipe, a rear wall, and a front door to form an enclosed shelter.

A further object of the invention is to provide tubing within the pipe wall through which heated water may be pumped in order to heat the interior of the shelter.

Yet another object of the invention is to group the shelters by placing the shelters adjacent to each other and/or on top of each other to effectively use space and to share a heating system.

These together with additional objects, features and advantages of the temporary homeless shelter will be readily apparent to those of ordinary skill in the art upon reading the following detailed description of the presently preferred, but nonetheless illustrative, embodiments when taken in conjunction with the accompanying drawings.

In this respect, before explaining the current embodiments of the temporary homeless shelter in detail, it is to be understood that the temporary homeless shelter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the temporary homeless shelter.

It is therefore important that the claims be regarded as including such equivalent construction insofar as they do not depart from the spirit and scope of the temporary homeless shelter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
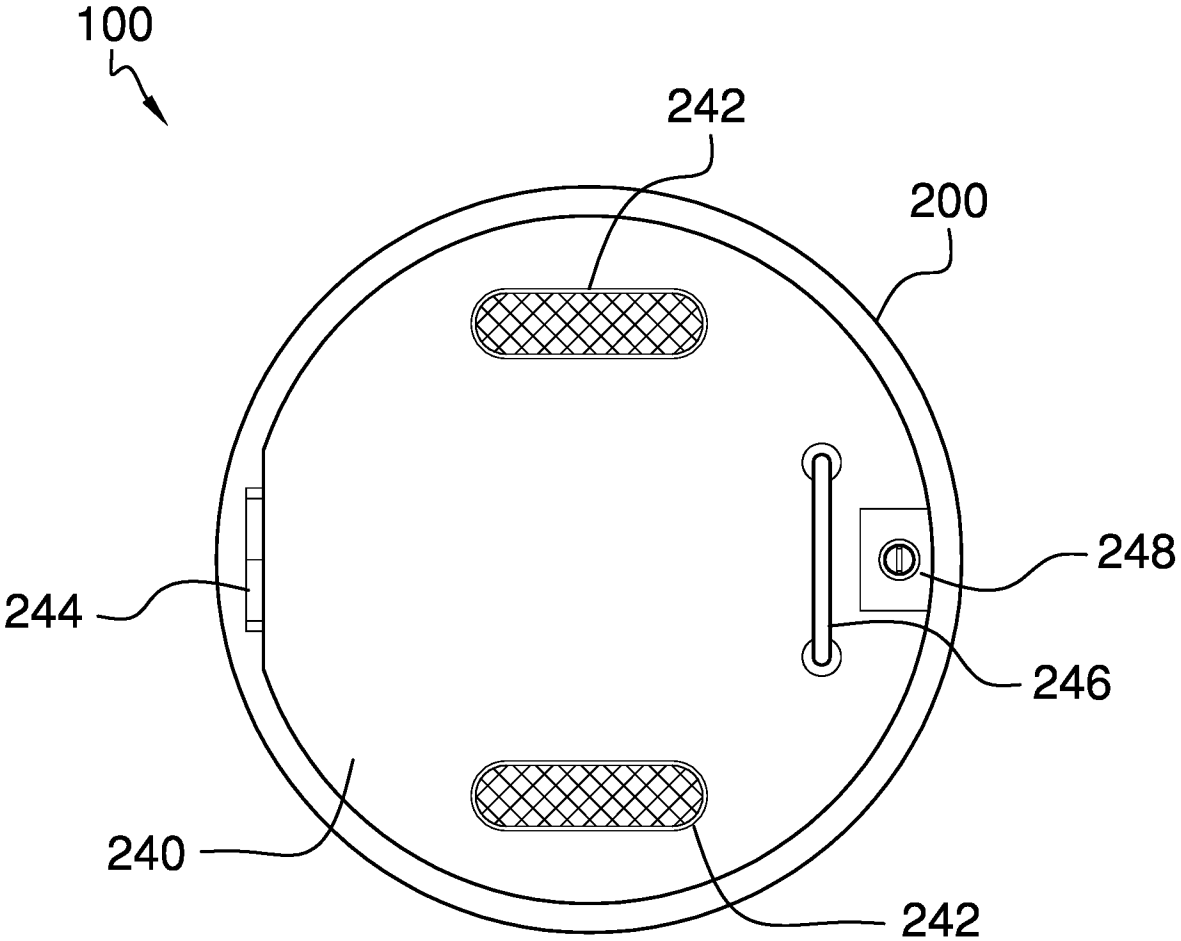
FIG. 1 is a front view of an embodiment of the disclosure, illustrating the front door in the closed position.
Figure 2:
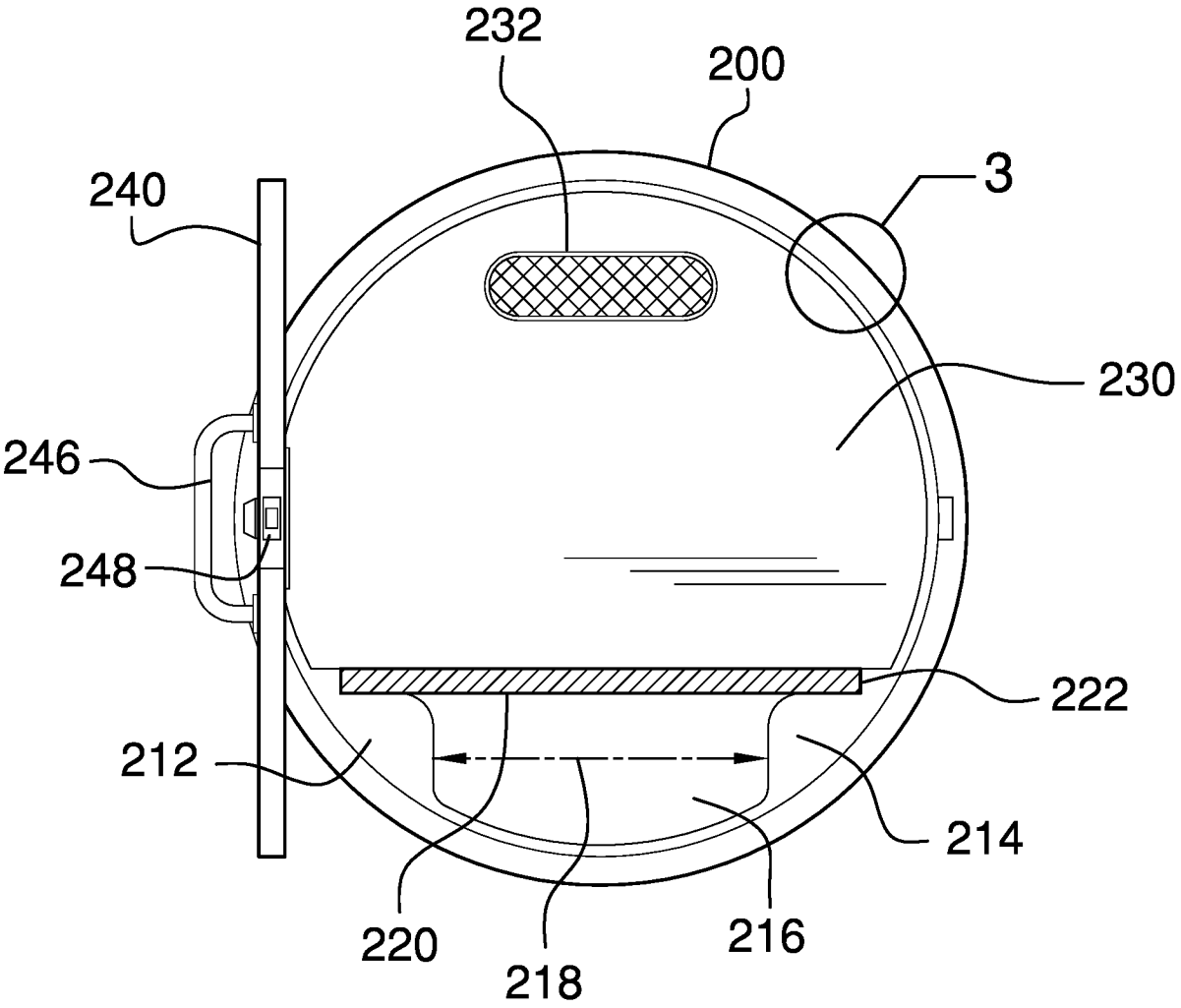
FIG. 2 is a front view of an embodiment of the disclosure, illustrating the front door in the open position.
Figure 3:
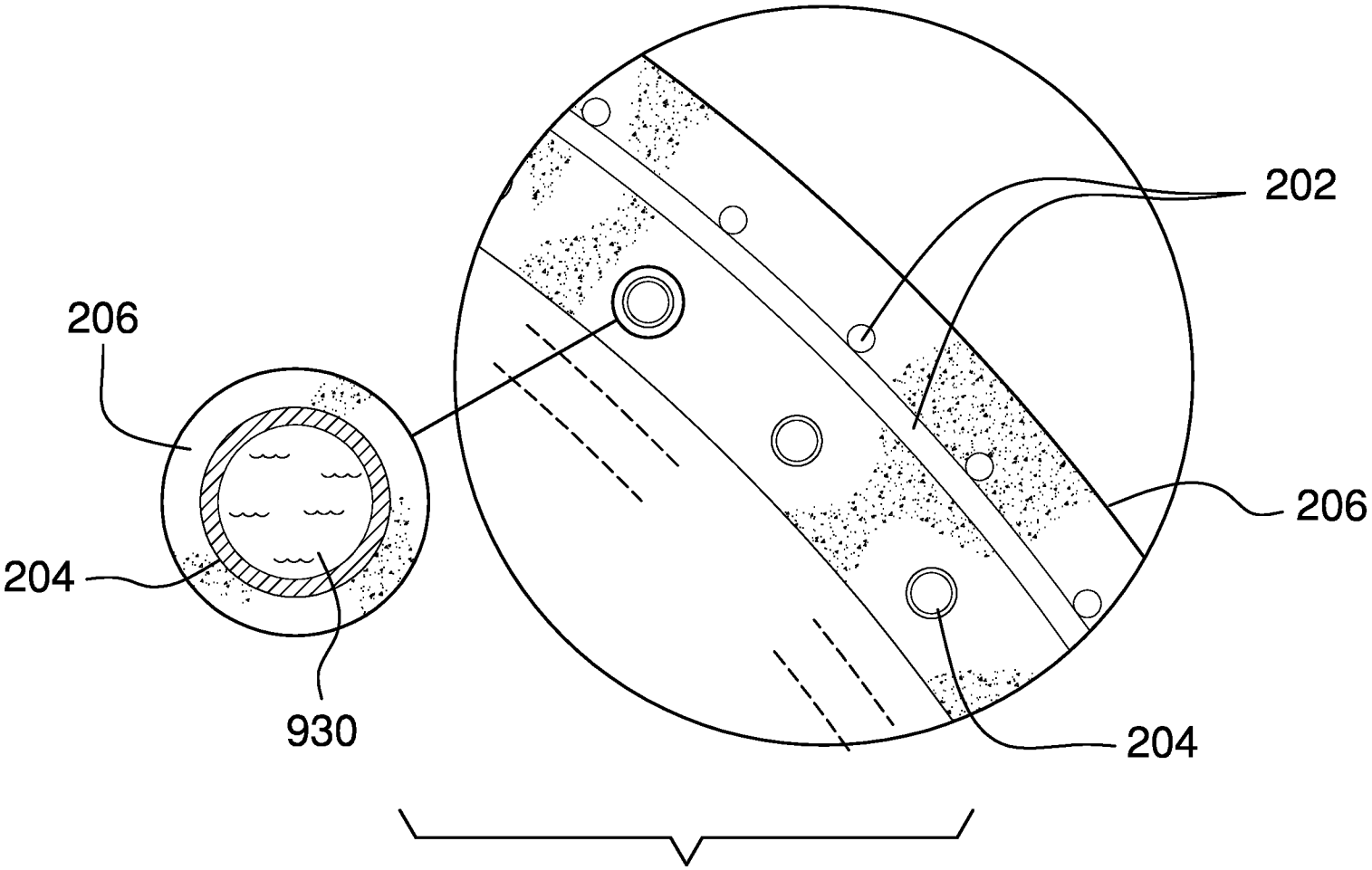
FIG. 3 is a detail view of an embodiment of the disclosure illustrating the area marked 3 as shown in FIG. 2.
Figure 4:
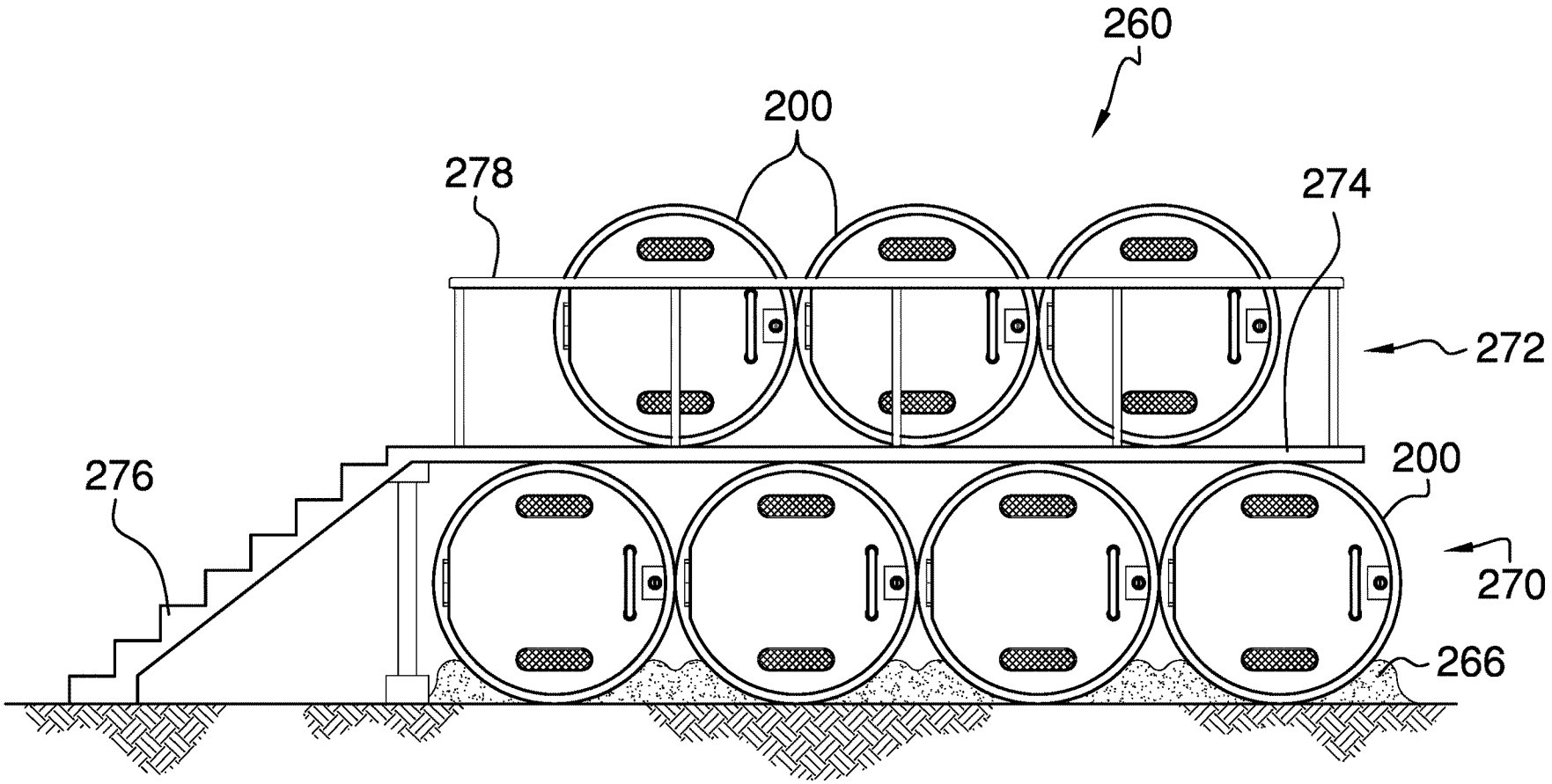
FIG. 4 is an in-use side view of an embodiment of the disclosure, illustrating grouping of a plurality of shelters.
Figure 5:
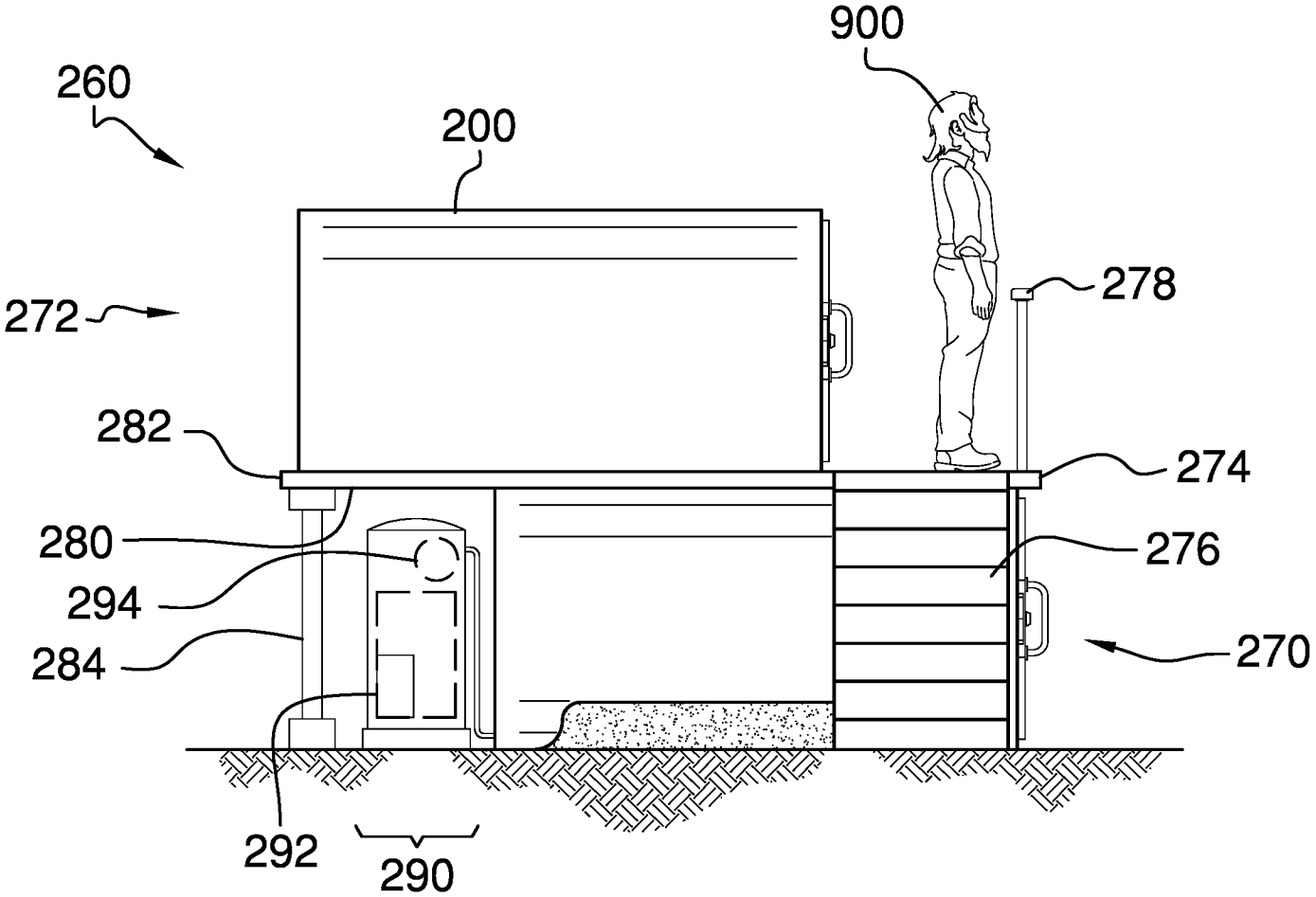
FIG. 5 is an in-use front view of an embodiment of the disclosure, illustrating grouping of a plurality of shelters.

Detailed reference will now be made to a first potential embodiment of the disclosure, which is illustrated in FIGS. 1 through 5.

The temporary homeless shelter 100 (hereinafter invention) comprises a reinforced concrete pipe 200, a rear wall 230, and a front door 240. The reinforced concrete pipe 200 may be closed by the rear wall 230 on one end and by the front door 240 on the opposite end. The invention 100 may be adapted to protect a homeless person 900 from the weather. Air may flow through the reinforced concrete pipe 200 when one or more rear vents 232 and one or more front vents 242 are open. Heated water 930 may be pumped through tubing 204 incorporated into a pipe wall 206 to heat the interior of the reinforced concrete pipe 200. A storage area 216 located under a bed platform 220 within the reinforced concrete pipe 200 may be operable to store personal belongings.

The reinforced concrete pipe 200 may be a hollow, cylindrical pipe that is reinforced by rebar 202 located within the concrete. The rear of the reinforced concrete pipe 200 may be closed off by the rear wall 230. The front of the reinforced concrete pipe 200 may be hingedly closed by the front door 240. The rebar 202 and the tubing 204 may be incorporated into the pipe wall 206 at the time the reinforced concrete pipe 200 is formed.

The tubing 204 may traverse the reinforced concrete pipe 200 longitudinally from rear to front multiple times. The tubing 204 may be exposed as a water inlet and a water outlet at the rear of the reinforced concrete pipe 200. The heated water 930 may be pumped into the water inlet, may circulate through the tubing 204, and may exit through the water outlet.

A pair of longitudinal ledges may be disposed on either side of the reinforced concrete pipe 200. A gap 218 between a left longitudinal ledge 212 and a right longitudinal ledge 214 may comprise the storage area 216. The storage area 216 may extend the entire longitudinal length of the reinforced concrete pipe 200. As a non-limiting example, the storage area 216 may be adapted to store the personal belongings of the homeless person 900.

The bed platform 220 may be a planar rectangular surface that may be placed into the reinforced concrete pipe 200 such that the bed platform 220 is oriented horizontally. The bed platform 220 may be placed on top of the pair of longitudinal ledges to cover the storage area 216 and to provide a level surface for sleeping. In some embodiments, the bed platform 220 may be divided longitudinally into one or more sections that may be removed to access the storage area 216. The storage area 216 may also be accessible from the front end of the reinforced concrete pipe 200 when the front door 240 is open, without having to remove the bed platform 220. In some embodiments, the pair of longitudinal ledges may comprise ledge offsets 222 such that the bed platform 220 fits flush and is prevented from tilting.

The front door 240 may be operable to seal the reinforced concrete pipe 200 when the front door 240 is closed and may be operable as an entrance/exit when the front door 240 is open. The front door 240 may be pivotably coupled to the reinforced concrete pipe 200 via a hinge 244. The front door 240 may comprise a handle 246 to aid in opening and closing the front door 240. The front door 240 may comprise a lock 248 that may prevent opening the front door 240 when locked. The lock 248 maybe adapted to be operated from inside the reinforced concrete pipe 200, outside the reinforced concrete pipe 200, or both. The front door 240 may comprise the one or more front vents 242 for ventilation. As a non-limiting example, the front door 240 may be made of fiber-reinforced plastic.

In a preferred embodiment, the reinforced concrete pipe 200 may be 8.0+/−0.5 feet long with an outside diameter of 4.0+/−0.25 feet. The pipe wall 206 may have a thickness of 4.0+/−1.0 inches. The storage area 216 may be 12.0+/−1.0 inches in height and 12.0+/−1.0 inches in width.

The invention 100 may be deployed into a grouping of shelters 260. The grouping of shelters 260 may be adapted to provide temporary living space for the homeless people 900 at a single venue. The grouping of shelters 260 may comprise a plurality of shelters positioned adjacent to each other and oriented to be parallel to each other with the rear walls 230 aligned at the rear of the reinforced concrete pipes 200 and the front doors 240 aligned at the front of the reinforced concrete pipes 200. A fill material 266 may be poured along the sides of the reinforced concrete pipes 200 to prevent the reinforced concrete pipes 200 from rolling.

In some embodiments, the plurality of shelters may be organized into a lower level of shelters 270 and an upper level of shelters 272 placed on top of the lower level of shelters 270. The upper level of shelters 272 may be offset laterally from the lower level of shelters 270 such that the upper level of shelters 272 rest in the longitudinal depressions between the reinforced concrete pipes 200 of the lower level of shelters 270. The lower level of shelters 270 may thus prevent the upper level of shelters 272 from rolling.

The upper level of shelters 272 may be offset to the rear such that the front doors 240 of the upper level of shelters 272 are positioned rearward of the front doors 240 of the lower level of shelters 270. The top front of the lower level of shelters 270 may be covered by a walkway 274 that is adapted for the homeless people 900 to walk on to access the front doors 240 on the upper level of shelters 272. The walkway 274 may comprise stairs 276 for climbing to the walkway 274 and a handrail 278 to prevent falls. In some embodiments, the upper level of shelters 272 may be offset to the rear by 3.0+/−0.5 feet.

In some embodiments, the walkway 274 may extend rearward under the upper level of shelters 272 to form a support platform 282. The rear of the support platform 282 may extend rearwards past the rear wall 230 of the lower level of shelters 270 creating a rear overhang 280. The rear overhang 280 and the upper level of shelters 272 above the rear overhang 280 may provide protection for equipment placed under the rear overhang 280. The rear overhang 280 may be braced by a plurality of support posts 284.

In some embodiments, a heating system 290 comprising at least a water heater 292 and a water pump 294 may be placed under the rear overhang 280. The water heater 292 may heat the heated water 930 which the water pump 294 may pump through the tubing 204 in the plurality of shelters. The heated water 930 may be pumped into the water inlet of a first shelter and may exit the water outlet of the first shelter. Hoses may couple the water outlet of the first shelter to the water inlet of a second shelter so that the heated water 930 may also circulate through the tubing 204 of the second shelter. This coupling of shelters using the hoses and pumping of the heated water 930 from one shelter to the next shelter may continue until the heated water 930 passes through all shelters and is pumped back to the water heater 292. As a non-limiting example, the invention 100 also anticipates that manifolds, valves, hoses, and other plumbing hardware may be used to create zones where the heated water 930 may be circulated through a subset of the shelters and where multiple subsets of the shelters may be defined by the plumbing.

In use, the invention 100 may be placed on the ground and immobilized. As a non-limiting example, the invention 100 may be immobilized by placing a fill material 266 on both sides of the reinforced concrete pipe 200 along the longitudinal length of the reinforced concrete pipe 200. A homeless person 900 may open the front door 240 and climb into the reinforced concrete pipe 200 to sleep on the bed platform 220. The homeless person 900 may place personal belongings into the storage area 216 located under the bed platform 220 either by accessing the storage area 216 from the front when the front door 240 is open or by lifting part or all of the bed platform 220 to access the storage area 216. The interior of the reinforced concrete pipe 200 may be ventilated by air flowing through the one or more front vents 242 and the one or more rear vents 232. The interior of the reinforced concrete pipe 200 may be heated by heated water 930 circulating through the tubing 204 incorporated into the pipe wall 206.

A grouping of shelters 260 may be organized by placing a plurality of shelters adjacent to each other. The plurality of shelters may be stacked to form a lower level of shelters 270 and an upper level of shelters 272. The upper level of shelters 272 may be offset to the rear and a walkway 274 and stairs 276 may provide easier access to the front doors 240 of the upper level of shelters 272. A heating system 290 may be placed under the rear overhang 280 created by offsetting the upper level of shelters 272 to the rear. The heating system 290 may pump the heated water 930 through one or more of the plurality of shelters.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object by which a tool, object, or door is held or manipulated with the hand.

As used in this disclosure, a "hinge" may be a device that permits the turning, rotating, or pivoting of a first object relative to a second object.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the word "interior" may be used as a relational term that implies that an object is located or contained within the boundary of a structure or a space.

As used in this disclosure, the word "lateral" may refer to the sides of an object or movement towards a side. Lateral directions are generally perpendicular to longitudinal directions. "Laterally" may refer to movement in a lateral direction.

As used herein, the word "longitudinal" or "longitudinally" may refer to a lengthwise or longest direction.

As used herein, "outside diameter" or "outer diameter" may refer to a measurement made on an object. Specifically, the outside diameter is the distance from one point on the outside of the object to a point on the opposite side of the object along a line passing through the center of the object.

As used in this disclosure, a "pump" may be a mechanical or electromechanical device that uses suction or pressure to raise or move fluids, compress fluids, or force a fluid into an inflatable object. As non-limiting examples, fluids may include both liquids, such as water, and gases, such as air.

As used herein, "rebar" may refer to "reinforcing bar". Rebar may be one or more steel bars or a mesh of steel wires used to reinforce concrete by increasing the tensile strength of the concrete structure incorporating the rebar. Rebar often comprises a textured surface in order to promote bonding between the steel and the concrete and to reduce the risk of the rebar slipping within the concrete.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A temporary homeless shelter comprising:

a reinforced concrete pipe, a rear wall, and a front door;

wherein the reinforced concrete pipe is closed by the rear wall on one end and by the front door on the opposite end;

wherein the temporary homeless shelter is adapted to protect a homeless person from the weather;

wherein air flows through the reinforced concrete pipe when one or more rear vents and one or more front vents are open;

wherein heated water is pumped through tubing incorporated into a pipe wall to heat the interior of the reinforced concrete pipe;

wherein a storage area located under a bed platform within the reinforced concrete pipe is operable to store personal belongings.

2. The temporary homeless shelter according to claim 1 wherein the reinforced concrete pipe is a hollow, cylindrical pipe that is reinforced by rebar located within the concrete;

wherein the rear of the reinforced concrete pipe is closed off by the rear wall;

wherein the front of the reinforced concrete pipe is hingedly closed by the front door.

3. The temporary homeless shelter according to claim 2 wherein the rebar and the tubing are incorporated into the pipe wall at the time the reinforced concrete pipe is formed.

4. The temporary homeless shelter according to claim 3 wherein the tubing traverses the reinforced concrete pipe longitudinally from rear to front multiple times;

wherein the tubing is exposed as a water inlet and a water outlet at the rear of the reinforced concrete pipe;

wherein the heated water is pumped into the water inlet, circulates through the tubing, and exits through the water outlet.

5. The temporary homeless shelter according to claim 4 wherein the bed platform is a planar rectangular surface that is placed into the reinforced concrete pipe such that the bed platform is oriented horizontally;

wherein the bed platform is placed on top of the pair of longitudinal ledges to cover the storage area and to provide a level surface for sleeping.

6. The temporary homeless shelter according to claim 5 wherein the bed platform is divided longitudinally into one or more sections that are removable to access the storage area;

wherein the storage area is accessible from the front end of the reinforced concrete pipe when the front door is open, without having to remove the bed platform.

7. The temporary homeless shelter according to claim 6 wherein the pair of longitudinal ledges comprises ledge offsets such that the bed platform fits flush and is prevented from tilting.

8. The temporary homeless shelter according to claim 6 wherein the front door is operable to seal the reinforced concrete pipe when the front door is closed and is operable as an entrance/exit when the front door is open;

wherein the front door is pivotably coupled to the reinforced concrete pipe via a hinge;

wherein the front door comprises a handle to aid in opening and closing the front door.

9. The temporary homeless shelter according to claim 8 wherein the front door comprises a lock that prevents opening the front door when locked;

wherein the lock may be adapted to be operated from inside the reinforced concrete pipe, outside the reinforced concrete pipe, or both.

10. The temporary homeless shelter according to claim 9 wherein the front door is made of fiber-reinforced plastic.

11. The temporary homeless shelter according to claim 9 wherein the reinforced concrete pipe is 8.0+/−0.5 feet long with an outside diameter of 4.0+/−0.25 feet;

wherein the pipe wall has a thickness of 4.0+/−1.0 inches;

wherein the storage area is 12.0+/−1.0 inches in height and 12.0+/−1.0 inches in width.

12. The temporary homeless shelter according to claim 9 wherein the temporary homeless shelter is deployed into a grouping of shelters;

wherein the grouping of shelters is adapted to provide temporary living space for homeless people at a single venue;

wherein the grouping of shelters comprises a plurality of shelters positioned adjacent to each other and oriented to be parallel to each other with the rear walls aligned at the rear of the reinforced concrete pipes and the front doors aligned at the front of the reinforced concrete pipes;

wherein a fill material is poured along the sides of the reinforced concrete pipes to prevent the reinforced concrete pipes from rolling.

13. The temporary homeless shelter according to claim 12 wherein the plurality of shelters are organized into a lower level of shelters and an upper level of shelters placed on top of the lower level of shelters;

wherein the upper level of shelters is offset laterally from the lower level of shelters;

wherein the lower level of shelters prevents the upper level of shelters from rolling.

14. The temporary homeless shelter according to claim 13 wherein the upper level of shelters is offset to the rear such that the front doors of the upper level of shelters are positioned rearward of the front doors of the lower level of shelters.

15. The temporary homeless shelter according to claim 14 wherein a top front of the lower level of shelters is covered by a walkway that is adapted for the homeless people to walk on to access the front doors on the upper level of shelters.

16. The temporary homeless shelter according to claim 15 wherein the walkway comprises stairs for climbing to the walkway and a handrail to prevent falls.

17. The temporary homeless shelter according to claim 16 wherein the upper level of shelters is offset to the rear by 3.0+/−0.5 feet.

18. The temporary homeless shelter according to claim 16 wherein the walkway extends rearward under the upper level of shelters to form a support platform;

wherein the rear of the support platform extends rearwards past the rear wall of the lower level of shelters creating a rear overhang;

wherein the rear overhang and the upper level of shelters above the rear overhang provide protection for equipment placed under the rear overhang;

wherein the rear overhang is braced by a plurality of support posts.

19. The temporary homeless shelter according to claim 18 wherein a heating system comprising at least a water heater and a water pump are placed under the rear overhang;

wherein the water heater heats the heated water which the water pump pumps through the tubing in the plurality of shelters;

wherein the heated water is pumped into the water inlet of a first shelter and exits the water outlet of the first shelter;

wherein hoses couple the water outlet of the first shelter to the water inlet of a second shelter so that the heated water also circulates through the tubing of the second shelter;

wherein this coupling of shelters using the hoses and pumping of the heated water from one shelter to the next shelter continues until the heated water passes through all shelters and is pumped back to the water heater.

* * * * *